United States Patent [19]

Schuster

[11] 4,102,464

[45] Jul. 25, 1978

[54] PALLET SAVER DEVICE FOR FORK LIFT TRUCKS

[75] Inventor: Frank C. Schuster, Peoria, Ill.

[73] Assignee: Little Giant Products, Inc., Peoria, Ill.

[21] Appl. No.: 768,056

[22] Filed: Feb. 14, 1977

[51] Int. Cl.[2] ..... B66F 17/00

[52] U.S. Cl. ..... 214/750; 214/620; 293/71 R

[58] Field of Search ..... 214/127, 620, 621, 650 R, 214/650 SG, 651, 750; 293/71 R

[56] References Cited

U.S. PATENT DOCUMENTS

| | | | |
|---|---|---|---|
| 1,921,661 | 8/1933 | Conner | 280/47.29 |
| 2,956,701 | 10/1960 | Larson | 214/750 |
| 3,034,675 | 5/1962 | Quayle | 214/730 |
| 3,080,080 | 3/1963 | Miller | 214/750 |
| 3,314,559 | 4/1967 | Horton | 214/650 R |
| 3,480,167 | 11/1969 | Varilek | 214/620 |
| 3,625,385 | 12/1971 | Ide | 214/750 |

*Primary Examiner*—L. J. Paperner

[57] ABSTRACT

A pallet saver device for fork lift trucks adapted for impact with the center strut of a pallet before contact of the fork fillets with the pallet during loading and lifting of a load on the pallet, without substantially adversely affecting load center, the said device being secured on the lift carriage of the truck between its spread forks and having means for removably mounting the device to the carriage. The device has a cushioned bumper extending from the carriage a distance greater than the thickness of the fork fillets, an impact panel backing up the bumper, and a spacer for selectively spacing the bumper and impact panel from the mounting means.

10 Claims, 4 Drawing Figures

PALLET SAVER DEVICE FOR FORK LIFT TRUCKS

BACKGROUND AND SUMMARY OF THE INVENTION

This invention relates to a pallet saver device for industrial trucks having spaced apart lift forks, and is more particularly directed to a cushioned impact device which may be secured to the lift truck carriage between its spread forks for contacting the center strut of a conventional pallet before contact between the pallet and the fillets of the lift forks.

Conventional fork lift trucks have a pair of vertically spaced apart L-shaped lift forks, one leg of each fork being connected to a lift carriage for vertical movement of the forks in unison; and the other leg of each fork extends outwardly from the truck in a horizontal direction to support a load, each horizontal and vertical leg being connected by a fillet. Often the load is carried by a pallet which is comprised of a center strut and two spaced apart parallel end struts, tied together top and bottom by stringers, the edges of the pallet between the struts and stringers being open to define pockets for engagement of the forks therein on each side of the center strut. Usually such pallets are fabricated from wood.

During entry of the forks into the pockets between the struts and stringers, the forks often hit the pallet with great force and impact, and repeated impact causes premature failure of the pallet, particularly at the point of contact between the fork fillets and the upper stringer of the pallet.

A prior art impact device is disclosed in Rudolph G. Larson U.S. Pat. No. 2,956,701, and provides means for cushioning force between the forks and a pallet; however, such a device moves the load outwardly on the forks, thus resulting in lost load center to reduce the capacity of the truck. Such a device contacts the end struts of the pallet, as well as the edge of the stringer boards, which are less resistant to breakage than the center strut and the center of the stringer. Also, where the impact device is intended to contact the end struts, adjustment of the forks toward one another brings the impact device out of alignment with the pallet, or if a narrow pallet is used the impact device may miss the pallet altogether. Additionally, lift truck operators frequently contact the pallet out of line and under such conditions devices adapted to contact the pallet ends are often ineffective because one side of the pallet may miss the impact device or there is greater impact on one side of the pallet than the other side.

A pallet saver device constructed according to the present invention is intended for impact with the center strut and the central areas of the stringers of the pallet, at their strongest point, where the impact may be absorbed by the entire pallet. The face of the device is preferably shock absorbing and projects forward of the front vertical surface of the forks, to prevent a crowbar or wedging effect of the fork fillets on the first stringers of the pallet, without substantial lost load center. The pallet saver device may be easily attached to the lift truck carriage and may be easily removed to permit removal or adjustment of the forks, all without modifications to the truck. The device embodying the invention may be fabricated with a changeable spacer plate, which permits it to be utilized with forks of varying thickness for all capacity trucks covered by standard industry fork mountings, and the device has novel keyed means for mounting it on the carriage.

OBJECTS OF THE INVENTION

It is therefore the object of the present invention to provide a pallet saver device of the character referred to capable of preventing substantial pallet damage without loss of load center.

Another object is to provide a pallet saver device for mounting on a lift truck between its spread forks which has impact structure protruding beyond the fork fillets.

Another object is to provide a pallet saver attachment for a fork lift truck which may be secured centrally of its carriage between its forks at a level adapted to contact the center strut of an open ended pallet before impact between the forks and the pallet.

Another object is to provide a pallet saver device with a cushioned impact panel.

Another object is to provide a pallet saver device which has selectively changeable spacer means adapted to compensate for forks of varying thickness.

Another object is to provide mounting means for an impact device keyed for securement to a lift truck carriage.

Another object is to provide a pallet saver device which is easy to mount, remove and use with conventional forks and carriages, is inexpensive to manufacture and install, and is very effective in use.

These and other objects and advantages of the invention will become more readily apparent as this description proceeds, taken in conjunction with the accompanying drawings.

DESCRIPTION OF A PREFERRED EMBODIMENT

Figure 1:
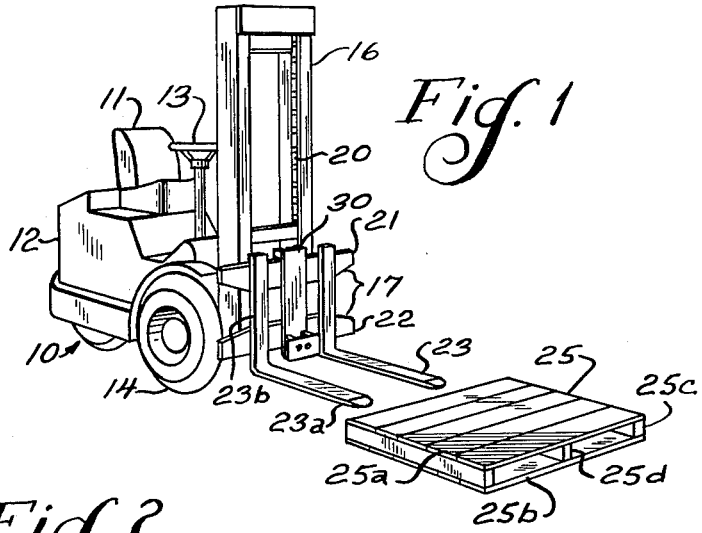
FIG. 1 is a perspective view of a fork lift truck and pallet, showing a pallet saver device embodying the present invention mounted on the lift truck carriage.
Figure 2:
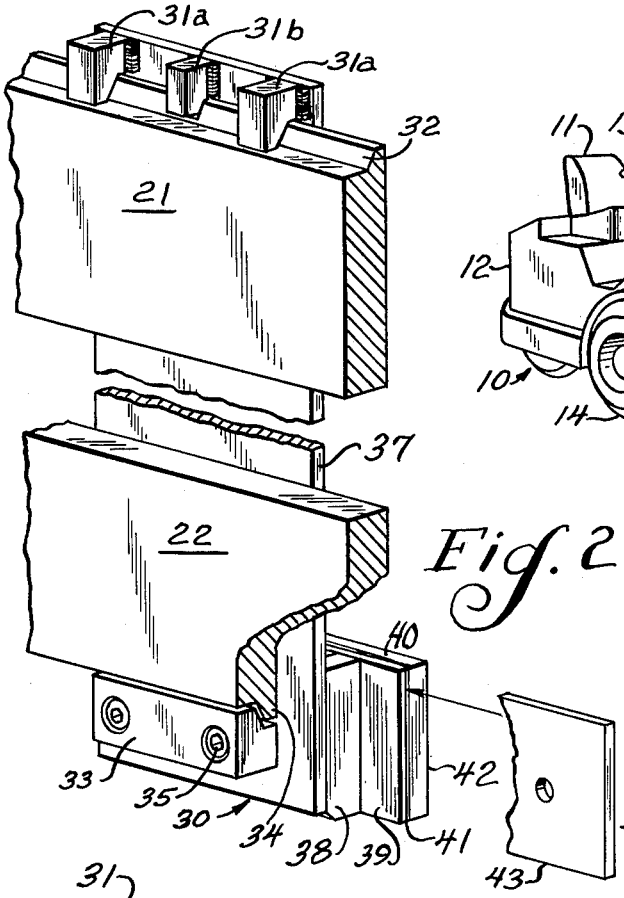
FIG. 2 is a rear prospective view of the pallet saver device mounted on a carriage partially in section.
Figure 4:
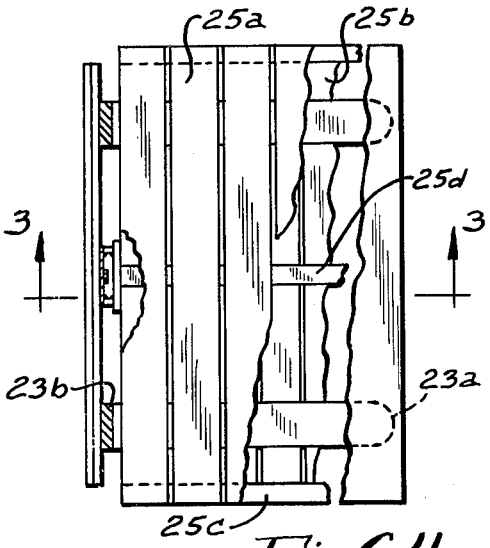
FIG. 4 is a top plan view of the pallet saver device, pallet and forks, partially in section and with parts broken away.
Figure 3:
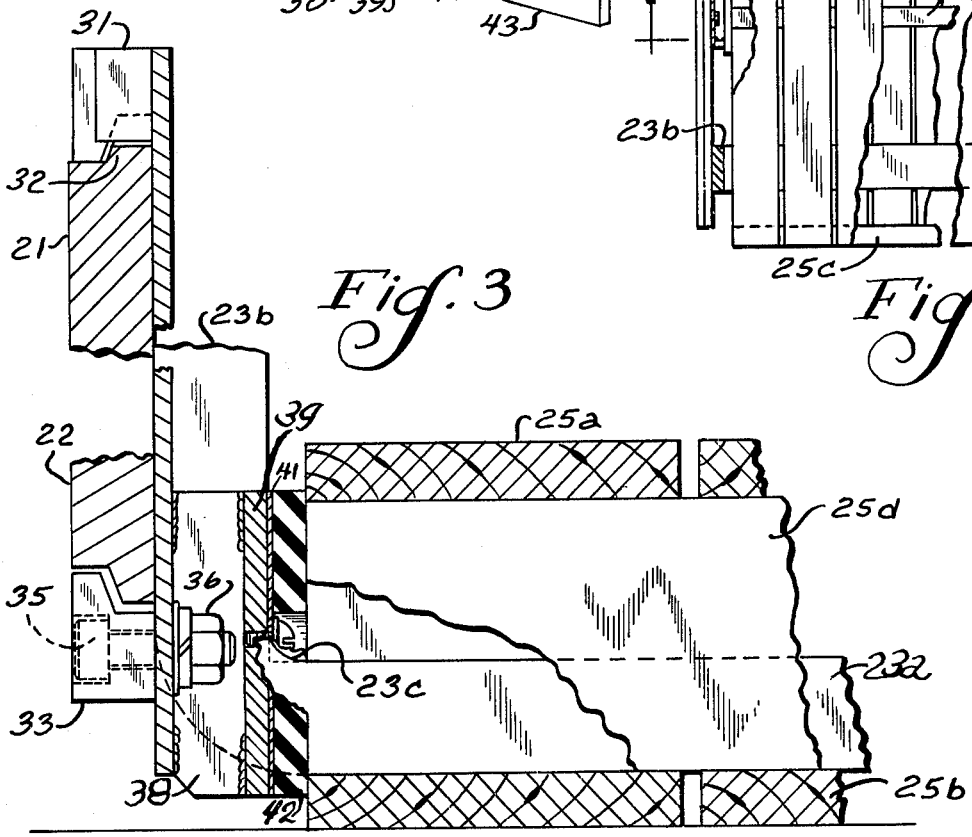
FIG. 3 is a partial section view of the pallet saver device, taken on line 3 — 3 of FIG. 4.

A typical lift truck 10 has an operator station 11, counterweighted truck body 12, steering wheel 13, wheels 14, and an upstanding mast 16, upon which is mounted a carriage 17, carried for vertical movement along the mast by chains 20. The carriage 17 has an upper cross beam 21 and a lower cross beam 22, which carries for movement therewith a pair of forks 23. These L-shaped forks have horizontally extending tines **23*a* and vertically extending legs 23*b* secured to the carriage, joined together by fillets or heels 23*c***.

Typically, a load is placed upon a pallet 25. A conventional pallet comprises upper stringers **25*a* and lower stringers 25*b*, tied together by end struts 25*c* and center struts 25*d***.

The pallet saver device 30 embodying the invention may be hung over the upper cross beam 21 of the carriage by means of upper hooks 31, comprised of end hooks **31*a* and a center key 31*b*, adapted to engage over the edge 32 of the cross beam. A lower block 33 of the pallet saver device is mounted on the lower edge 34 of the lower cross beam 22, as by bolts 35 and nuts 36 extending through said block and a plate 37** to complete the mounting.

Spacers 38, which may be of varying thickness depending upon the thickness of the forks 23, are secured to the plate 37, as by welding, which also secure an impact plate 39 on the spacers 38, and a bumper plate 40 on the impact plate 39, the bumper plate 40 being comprised of a rigid back-up member 41 bonded to a cushioned member 42, preferably of resilient solid rubber or the like.

In use, the operator from his station 11 drives the truck 12 with the carriage 17 lowered so that the fork tines 23*a* are at a level to enter the pallet 25 in the pockets defined by the stringers 25 *a-b* and struts *c-d*, and the cushioned bumper 40 contacts the pallet center strut 25*d* before the vertical leg 23*b* or fork fillets 23*c* hit the pallet, thus absorbing impact shock. The pallet saver 30 may be removed from the truck by merely withdrawing the block 33 from the plate 37 to free the lower carriage beam 22. Spacers 43 of varying thickness may be selectively substituted responsive to varying fork thicknesses, or worn bumpers 40 may be changed by withdrawing the bolts 38*a*.

Preferably, the upper beam 21 of the carriage 17 may be grooved to easily accommodate the key hook 31*b* for facilitating mounting of the pallet saver 30 in central position for proper alignment with the pallet 25.

While a preferred embodiment of the invention has been described in considerable detail, various changes and modifications in the structure shown and described may be made without departing from the spirit or scope of the invention, and it is not desired that the invention should be limited to the specific embodiment described and shown.

I claim:

1. In an attachment for a lift truck having a pair of spaced apart forks extending therefrom for handling a pallet, each fork having a leg secured to a carriage vertically movable on said truck and a horizontally projecting tine defining a surface for carrying a load connected to said leg by a fillet, said attachment comprising: mounting means for securing said attachment to and extending from said carriage, an impact bumper carried by said mounting means, and a contact surface on said impact bumper forward of said fork legs and fillets and positioned for initial contact with said pallet free of the other elements of said attachment, said bumper and said contact surface being mounted centrally of the carriage between and out of contact with said forks and extending in line with and below the plane of said fork load carrying surface and adapted for cushioned impact centrally of said pallet before the vertical legs and fillets of said forks contact said pallet.

2. In the attachment recited in claim 1, wherein said mounting means comprises a plate removably secured to said carriage and a pair of spacers extending from said plate on opposed edges thereof.

3. In the attachment recited in claim 1, wherein said carriage has vertically extending upstanding beam means and said mounting means is secured to said beam means top and bottom.

4. In the attachment recited in claim 3, wherein said mounting means comprises a plurality of hangers for securing said mounting means over said beam means and a mounting block for removably securing said mounting means to the beam means.

5. In the attachment recited in claim 4, wherein said top beam is grooved and one of said hangers is keyed for centering said attachment on said carriage.

6. In the attachment recited in claim 4, in which the edge of said beam means has a horizontal lip extending transversely of said carriage and said mounting means has a shoulder for engaging said lip.

7. In the attachment recited in claim 1, in which said bumper is removable from said mounting means.

8. In the attachment recited in claim 7, in which said removable bumper is adjustable.

9. In the attachment recited in claim 1, in which said contact surface comprises a cushioned member for impact with the center strut of said pallet and a rigid back-up plate coextensive with said cushioned member.

10. In the attachment recited in claim 1, in which said mounting means is substantially coextensive with said carriage in a vertical direction and of a heighth greater than the heighth of said bumper.

* * * * *